US005256085A

United States Patent [19]

Tan et al.

[11] Patent Number: 5,256,085

[45] Date of Patent: Oct. 26, 1993

[54] CONNECTOR WITH IMPROVED ESD PROTECTION MECHANISM

[75] Inventors: Haw-Chan Tan; Frank Ma, both of Diamond Bar; Yuan-Chieh Lin, Lake Forest, all of Calif.

[73] Assignee: Foxconn International, Inc., Sunnyvale, Calif.

[21] Appl. No.: 972,159

[22] Filed: Nov. 5, 1992

[51] Int. Cl.[5] ..... H01R 13/648

[52] U.S. Cl. ..... 439/607; 439/372

[58] Field of Search ..... 439/92, 95, 101, 108, 439/372, 484, 607, 609, 610

[56] References Cited

U.S. PATENT DOCUMENTS

| | | | |
|---|---|---|---|
| 4,671,594 | 6/1987 | Ohtsuki et al. | 439/607 X |
| 4,685,758 | 8/1987 | Yoshida | 439/607 X |
| 4,822,303 | 4/1989 | Nakamura et al. | 439/607 |
| 4,854,890 | 8/1989 | Nishimura | 439/607 |
| 4,938,704 | 7/1990 | Fujiura | 439/607 X |

*Primary Examiner*—Daniel W. Howell

*Assistant Examiner*—Khiem Nguyen

[57] ABSTRACT

A receptacle connector (10) includes an insulative housing (12) having a front mating portion (14) projecting from a front face (16) of a flange section (18) and having a mating face (20) in the front. A pair of rows of passageways (70) extend longitudinally within the connector (10) to receive a plurality of corresponding contacts (52, 60) therein, respectively. A central cavity (50) is positioned along the lateral center line and extends inwardly from the mating face (20) for receiving a blade of a complementary plug connector therein. A conductive shield (80) has a shroud adapted to surround the front mating portion (14) wherein the front portion of the shield (80) extends vertically an appropriate distance toward the cavity (50). The edge of the front portion of the shield (80) is serrated for designedly stimulating point effect of an electrical discharge and effectively preventing any high voltage electrostatic charge from invading the internality of the connector (10) and damaging the internal circuit connected to the connector (10).

10 Claims, 4 Drawing Sheets

CONNECTOR WITH IMPROVED ESD PROTECTION MECHANISM

BACKGROUND OF THE INVENTION

1. Field of The Invention

This invention generally relates to connectors having ESD (Electrostatic Discharge) protection means, particularly to a female centronic type connector having a specific type front edge of its metal shield incorporating a shorter distance, relative to the contacts therein, with respect to an outside electrostatic charge source.

2. The Prior Art

As known, when the ambient relative humidity drops to fifty percent or below, the human body accumulates a large electrical charge. As disclosed in U.S. Pat. No. 4,824,377 to De Burro, such electrostatic voltage can be in excess of 20,000 volts which is normally dissipated without harm for a human under a situation that the person will be unaware that the electrostatic voltage has been discharged. However, this electrostatic discharge can be potentially damaging to certain electronic components. A specific instance of concern is when the electrostatic voltage is discharged into an assemblage of electronic components. More specifically, when a pin connector is unmated, the electronic components which are connected to this unmated connector are susceptible of receiving, through the conductive pins of the unmated connector, an electrostatic discharge which can result from an electrostatically charged human or other sources of an electrostatic charge.

Accordingly, De Burro uses a separate electrostatic discharge wire which transverses a path encircling or between two rows of pin insertion holes to catch or direct the electrostatic discharge thereto, thus preventing damaging levels of an electrostatic discharge from reaching the pins of the connector when not mated.

It can be appreciated that this type of pin connector is directed to a D-Subminiature female connector as disclosed in De Burro which has a substantial mating surface allowing installation of the wire thereof. In contrast, as disclosed in U.S. Pat. Nos. 5,102,353 and 5,104,326, a centronic type receptacle connector is generally disposed on the backplane of a computer and mating with a plug connector which has a blade inserted into the central cavity of this centronic type receptacle connector and having the traces along the edge for electrically engaging the corresponding contacts within the receptacle connector. It can be seen that there is no possibility for a centronic type receptacle connector to have a wire positioned between two rows of the female contacts because it will be an obstacle to insertion of the blade of the plug connector into the cavity of the receptacle connector. It is also unexpected to have a wire additionally attached onto the front mating surface of the centronic type receptacle connector and encircling those female contact passageways for ESD protection because there is hardly a sufficient space for loading a wire thereunto and forming a recess in a miniature connector to hold such wire therein. It tends to increase manufacturing problems and weakens the strength of the molded connector structure, especially in a miniature style connector. Another problem results from a relatively high volt electrostatic charge which may still easily jump the space and invade the internal electrical circuit through the contact even though the distance from the electrostatic charge source to the internal contacts of the connector is longer than that to the wire.

Accordingly, this invention is directed toward a new type of centronic type receptacle connector which provides ESD protection means directly on the shield which encloses the insulative housing with no separate additional wire needed.

SUMMARY OF THE INVENTION

One object of the present invention is to provide simple integral ESD protection mechanism on a centronic type receptacle connector thus requiring no additional external means attached thereto.

Another object of the present invention is to provide a complete centronic type receptacle connector which avoids the manufacturing complexity associated with the prior art.

Yet, another object of the present invention is to provide a connector having an ESD protection means which can effectively prevent outside electrostatic charge from invasion into the internal electrical circuit through the contacts therein.

In accordance with the present invention, a centronic type receptacle connector includes an insulative housing having a front mating portion projecting from a front face and having a mating face in the front. A pair of rows of passageways extend longitudinally within the connector to receive a plurality of corresponding contacts therein, respectively. A central cavity is positioned along the lateral center line and extends inwardly from the mating face for receiving a blade of a plug connector therein. The tails of the contacts are soldered on a circuit board to secure the connector thereon. A conductive shield has a shroud adapted to surround the front mating portion of the housing wherein the front portion of the shield extends vertically an appropriate distance toward the cavity. The edge of the front portion of the shield is serrated for designedly stimulating point effect of an electrical discharge and effectively preventing any high voltage electrostatic charge from invading the internality of the connector and damaging the internal circuit connected to the connector.

Each contact has an arched section protruding into the central cavity near the front end for electrical engagement with the electrical trace on the blade of the plug connector. For an electrostatic charge source positioned in a distance from the front opening of the cavity, the distance to the serrated edge of the shield is equal to or less than that to the arched sections of the contacts so that the electrostatic charge tends to travel through the shield rather than through the contacts, thus reducing the possibility of invasion of electrostatic charge.

DESCRIPTION OF THE PREFERRED EMBODIMENT

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
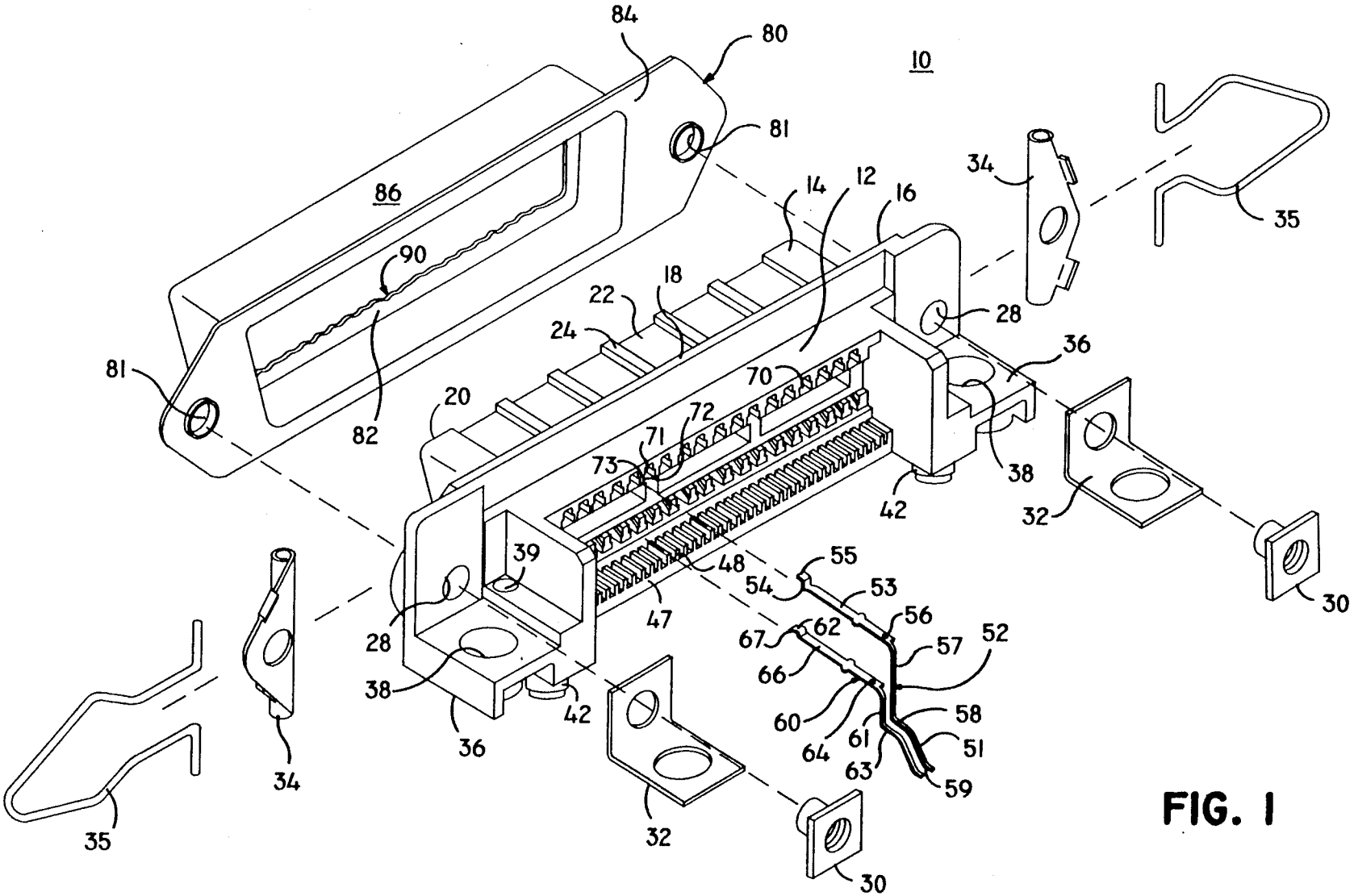
FIG. 1 is an exploded perspective view of a centronic type female connector provided with electrostatic discharge protection mechanism in accordance with the present invention wherein only a pair of upper contact and lower contact are shown for illustration.
Figure 2:
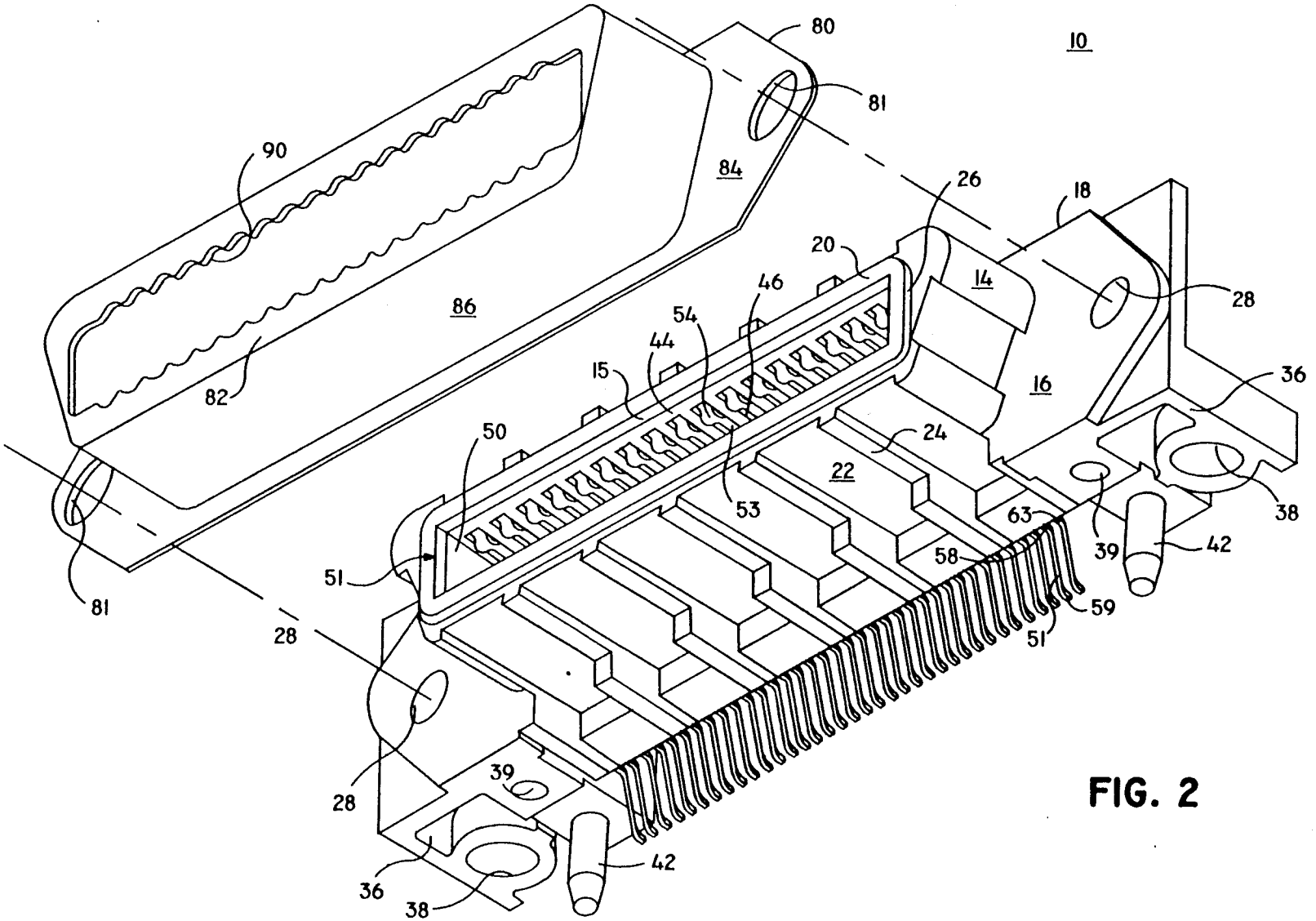
FIG. 2 is a front perspective view of the connector of FIG. 1 without some attached components, but with an unattached shield illustrating the relation between the connector housing and the shield.
Figure 3:
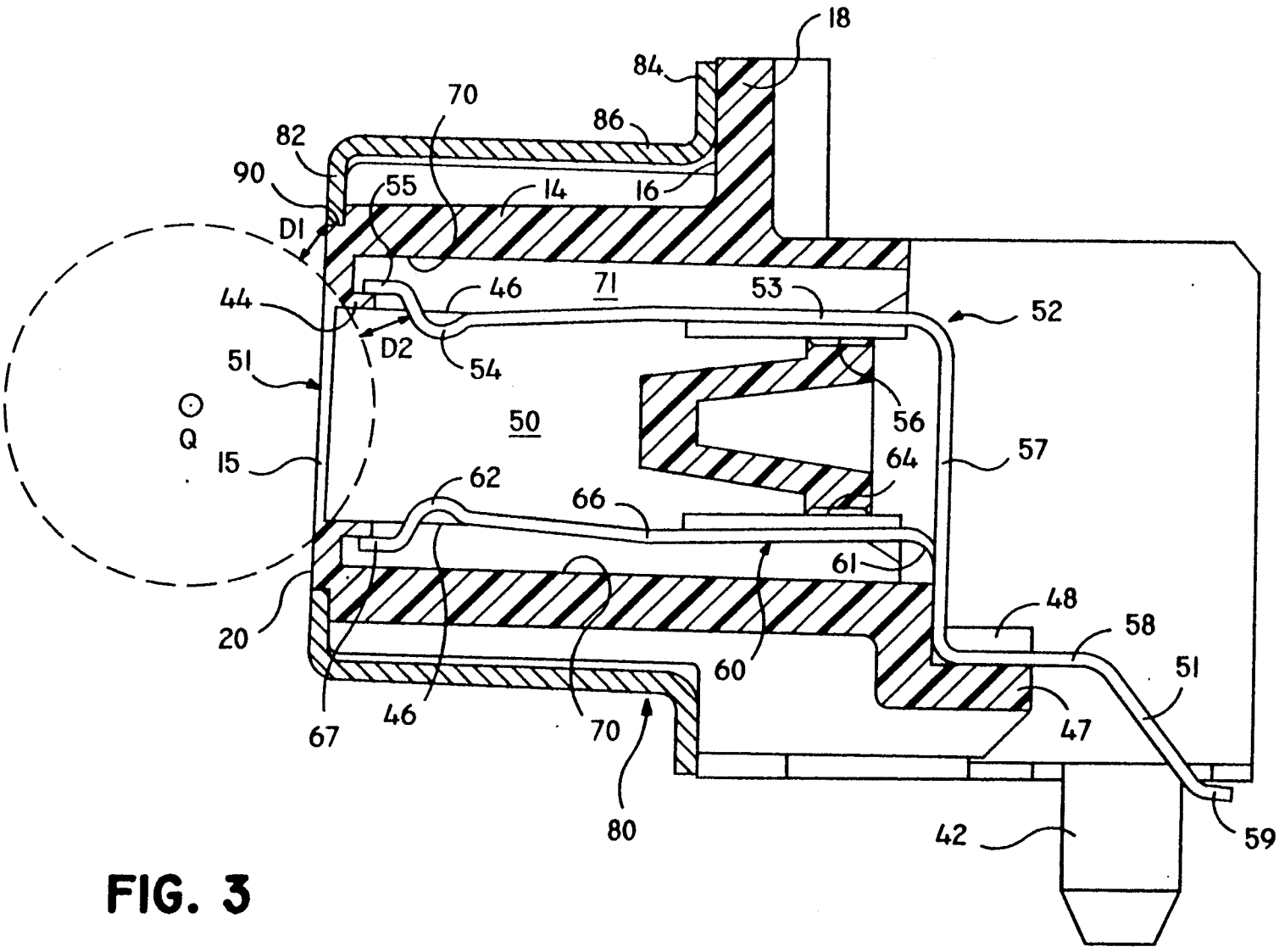
FIG. 3 is a cross-sectional view of the connector of FIG. 1 to show the distance difference to an external charge between the shield and the contact.

Referring to FIGS. 1, 2 and 3, the subject female or receptacle connector of a centronic type which is adapted to be mounted on a printed circuit board (not shown), is generally designated by the numeral 10. The electrical connector 10 comprises an insulative elongated housing 12 having a trapezoidal front mating portion 14 projecting thereof from a front face 16 positioned on a flange section 18 and having a mating face 20 in the front.

A plurality of side-by-side grooves 22 are disposed in the periphery of the mating portion 14, thus forming a corresponding number of ribs 24 therebetween for the consideration of easy molding process of the whole connector 10. A circumferential recess 26 are provided on the mating face 20 of the mating portion 14 for receiving a corresponding vertical flange 82 of a metal shield 80 which surrounds the mating portion 14 and will described in detail later.

Figure 4:
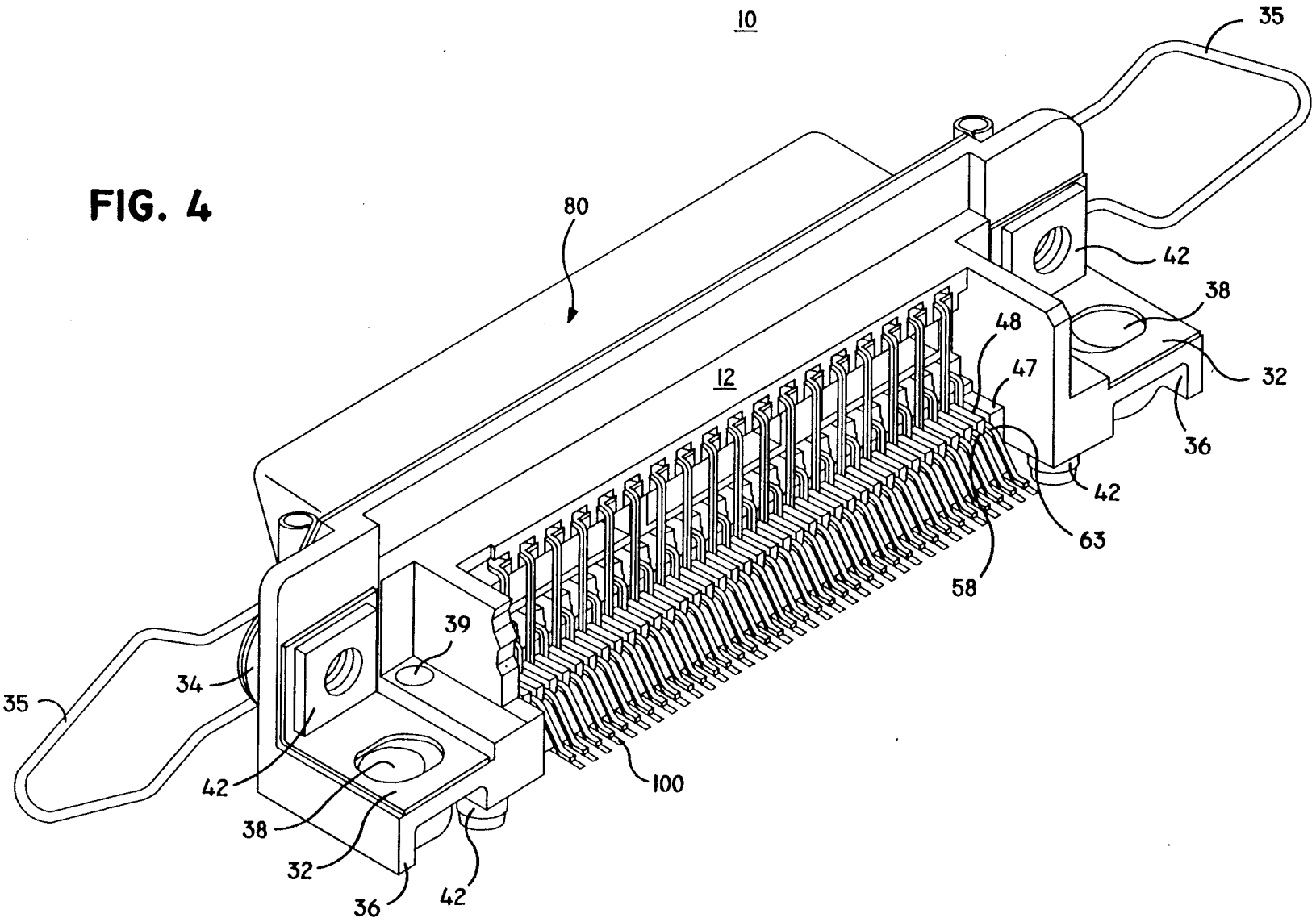
FIG. 4 is a perspective view of an assembled connector of FIG. 1 showing the upper and lower contacts are aligned in the rear.

Referring to FIGS. 1, 2 and 4, a pair of retention holes 28 are provided on two opposite sides of the flange section 18 of the housing 12 for each incorporating an internal threaded retaining rivet 30 to fasten a mounting bracket 32, a clip bail 35 and the metal shield 80 together thereto. As used in the prior art, the interior threads of the rivet 30 cooperates with a screw (not shown) for securement of the connector 10 on a backplane of a computer and the bail 35 on the strip 34 secures a complementary plug connector (not shown) thereto. The housing 12 further includes a pair of mounting sections 36 positioned on the opposite two ends of the housing 12 in alignment with the corresponding holes 28, respectively, for respective positioning of the corresponding mounting bracket 32 thereon. Each mounting section 36 has a mounting hole 38 in a vertical direction for securement with a chassis (not shown) by a screw (not shown). A post 42 extends downwardly from the mounting section 36 proximate to each mounting hole 38 for the purpose of the initial securement of the connector on the aforementioned board on which the connector is mounted. An aperture 39 is aligned with the post 42 in the front-to-back direction for securement of the connector with the aforementioned board by a screw (not shown).

Referring to FIGS. 1, 2 and 3, a plurality of two-row (upper and lower) passageways 70 extend through the housing 12 in the front-to-back direction. Each of the passageways 70 has a communication opening 46 communicating with and facing to a cavity 50 which is provided in the center portion of the mating portion 14 of the housing 12 and extends through the front mating face 20 thereof for therein reception of a blade of the aforementioned complementary plug connector (not shown). As shown in FIGS. 1 and 3, the peripheral front edge 15 of the mating portion 14 is chamfered, proximate the front opening 51 of the cavity 50, for easy insertion of the blade of the plug connector into the cavity 50.

Each passageway 70 in the upper row receives an upper contact 52 therein and each passageway 70 in the lower row receives a lower contact 60 therein. The upper contact 52 has a flat body 53, an arched section 54 on the front portion, a narrowed engagement section 55 at the front end, and an embossment 56 positioned on the rear portion of the body 53. A slender tail 57 downwardly extends from the left side of the rear end of the body 53 and has a right angle bend portion 58 for positioning in a corresponding slot 48 defined in a rear platform 47 formed on the rear portion of the housing 12. The end section of the tail 57 includes a slanted portion 51 extending from the bend portion 58 for approaching the aforementioned circuit board, and a solder leg 59 closely parallel to the board. The lower contact 60 has a similar configuration as the upper contact 52 except that the tail 61 of the lower contact 60 is shorter than the tail 57 of the upper contact 52 for compensation of the position difference, and the arched section 62, the embossment 64 and the engagement section 67 of the lower contact 60 are directed to an opposite direction in comparison with those, i.e., the arched section 54, the embossment 56 and the engagement securement 55, of the upper contact 52 because the upper contacts 52 and the lower contacts 60 are symmetrical to each other with respect to the cavity 50. Another difference is that the tail 61 of the lower contact 60 extends downwardly from the right side of the rear end of the flat body 66 of the lower contact 60.

Each of the upper passageways 70 has an upper narrow portion 71, a lower wide portion 72 and a shoulder 73 formed therebetween for restraint of upward motion of the flat body 53 of the upper contact 52 while allowing the narrowed engagement section 55 freely movably positioned within the upper narrow portion 71, as shown in FIG. 3, to provide a space for facilitating flexibility of the front portion of the upper contact 52 which incorporates the blade of the complementary plug connector. The securement of the contact 52 within the passageway 70 is performed with an interference fit between the flat body 53 of the contact 52 and the wide portion 72 of the passageway 70 in a horizontal direction, and another interference fit is provided on the housing 12 by the embossment 56 of the contact 52 due to the shoulder 73 restricting the contact therein in a vertical direction. The lower passageway 70 has a reversed cross-sectional profile with regard to the upper passageway 70 for reception of the corresponding lower contact 60 in a similar way.

Referring to FIG. 3, the engagement section 55 abuts against the restraining block 44 which blocks the front end of the communication opening 46 for restraining the deflection of the front end, i.e., engagement section 55, of the contact 52. Because of the restraining block 44, the contact 52 can be pre-deflected whereby the contact 52 may be made having a low spring rate resulting in little variation in normal force with changes in the thickness of the blade which is inserted within the cavity 50. Pre-deflecting the contact 52 also reduces the force needed to insert and withdraw the blade of the complementary plug connector. The lower contact 60 is designed in the same situation as the upper contact 52.

It can be appreciated that because the tails 61 of the lower contacts 60 and the tails 57 of the upper contacts 52 respectively protrude from different sides of their own flat bodies 66 and 53, for every pair of corresponding upper contact 52 and the lower contact 60, the tail 61 of the lower contact 60 and the tail 57 of the upper contact 52 can be biased from a vertical center line defined thereof, thereby to be able to be alternately arranged in one line for the convenience of configuration and assembling. As shown in FIG. 4, the right angle bends 58 of the upper contact tails 57 and the right angle bends 63 of the lower contact tails 61 are alternatively aligned within the corresponding slot 48 of the rear platform 47, and the solder legs 59 of the upper contacts 52 and those of the lower contacts 60 are alternatively aligned for electrically engagement with juxtaposed electrical traces 100 printed on the board (not shown).

The metal shield 80 has a front surface 84 covering the front face 16 of the housing 12 and including a pair of holes 81 positioned on two sides each in alignment with the corresponding hole 28 of the housing 12 for securement thereto by the rivet 30, and a shielding portion 86 projecting from the front surface 84 and encircling the mating portion 14 of the housing 12 except the mating face 20. As aforementioned before, the flange 82 extends vertically from the periphery of the front end of the shielding portion 86 of the shield 80 toward the front opening 51 of the cavity 50 thereby to be received in the circumferential recess 26 on the mating surface 20 of the housing 12 (see FIGS. 2 and 3). It can be seen that the flange 82 of the shield 80 is flush with the mating face 20 of the housing 12 for maintaining the same structural dimension of the connector assembly for mating with the designated complementary plug connector.

The front edge 90 of the flange 82 of the shield 80 is serrated or continuously notched to effectively capture the outside electrostatic charge for grounding. It can be understood that it is improper and impractical that the front edge 90 of the shield flange 82 vertically extends too much close to the front opening 51 of the center cavity 50 only for the consideration of electrostatic discharge protection, because this will have the corresponding abutting portion of the housing 12 become thinner to leave the space for reception of the enlarged flange, thus jeopardizing the structural strength of such portion around the restraining block 44 in the housing 12 thereby easily making a crash thereabout. On another viewpoint, because the restraining block 44 associated with the engagement section 55, 67 and arched section 54, 62 of the contact 52, 60 is designedly positioned as close to the mating face 20 as possible for better mechanical and electrical engagement with the corresponding trace on a blade of the complementary plug connector, it is improper to move the aforementioned portions rearward for the purpose of keeping an identical thickness of the housing thereabout as original. In other words, any rearward entire placement of those aforementioned portions for compensation of the excessively extended flange 82 of the shield 80 will lower the effective performance of the contacts originally designed.

Based on the foregoing limitations, the extent of the flange 82 is critical to the whole structure of the connector design. One approach of the present invention is have the front edge 90 of the flange 82 positioned as close to the front opening 51 of the central cavity 50 as possible so that any external electrostatic charge source positioned in a distance from the front opening 51 of the cavity 50 will be directed to the front edge 90 of the flange 82 rather than to the arched section 54 or 62 of the upper contact 52 or lower contact 60 according to Coulomb's Law because the distance D1 from the charge source Q to the front edge 90 of the flange 82 is shorter than the distance D2 from the same to the arched section 54 of the contact 52, as shown is FIG. 4. It can be understood that the present invention has tried to achieve an optimal design which has at best a longer extension of the flange 82 thus being in an advantageous geometrical position to effectively catch the electrostatic charge in comparison with the arched sections 54, 62 of contacts 52, 60 for ESD protection but still not to jeopardize the housing structure strength of the connector.

As aforementioned, even though in such situation, some relatively high voltage charge may still invade the internal portion of the connector through the exposed contacts. In another situation, some electrostatic charge sources may appear very close to the front opening 51 of the cavity 50 from which the distance to the arched section 54 of the contact 52 is equal to or less than that to the front edge 90 of the flange 82, thus resulting in an unfavorable position. For foregoing both potential disadvantageous situations, the present invention disposes a series of notches at the front edge 90 of the flange 82 which will overcome those advantages, according to "Point Effect" phenomenon, by effectively attracting the charge source rather than the projecting arched section 54, 62 of the contact 52, 60 and achieve the designated protection goal even under the worse conditions aforementioned.

It is noted that, compared with the prior art, the present invention omits the additional wire which is inserted into a slot surrounding or positioned between the front openings of the passageways of the connector as disclosed in U.S. Pat. No. 4,824,377. It saves material, labor and time in manufacturing and assembling.

It is contemplated that in this embodiment of the present invention, the front edge 90 of the flange 82 has a continuing wave section in the vertical direction, and the flange 82 is flush with the mating face 20 of the connector 10 for corresponding to exactly mating with a complementary plug connector. Alternatively, under the condition which does not affect the mating of the subject female connector 10 and the complementary plug connector, the front edge 90 of the flange 82 may be formed as a straight line in a front view, but the front portion of the flange 82 may have a continuing wave section in the front-to-back direction for performing the same function. In other words, if available and allowable, the front edge 90 of the flange 82 may be formed as different configuration which has a plurality of projecting points around the front opening 51 of the cavity 50 for point effect consideration.

While the invention has been described in connection with what is presently considered to be the most practical and preferred embodiments, it is to be understood that the invention is not limited to the disclosed embodiment but, on the contrary, is extended to cover various modifications and equivalent arrangements included within the spirit and scope of the appended claims.

Therefore, persons of ordinary skill in this field are to understand that all such equivalent structures are to be included within the scope of the following claims:

What is claimed is:

1. A female electrical connector with improved ESD protection means including:

an elongated insulative housing having a plurality of passageways extending in a front-to-back direction therein, each of said passageways receiving a corresponding contact therein;

a mating portion projecting from a front face of the housing for matable electrical engagement with a complementary plug connector and having a mating face thereof in the front;

a central cavity positioned within the mating portion and extending through the mating face for receiving a blade of the complementary plug connector, said contacts projecting into said cavity for electrical engagement with a plurality of corresponding traces printed on the blade of the plug connector; and a conductive metal shield covering the mating portion of the housing;

the improvement comprising;

said metal shield including a set of flange vertically extending a distance from a periphery of a front end of the shield toward a front opening of the cavity wherein a front edge of the flange close to the front opening of the cavity is serrated to expose a series of projecting points thereon under a condition that said front edge of the flange is serrated in a vertical direction and the mating face of the mating portion has a circumferential recess generally configured by four straight lines to receive the flange of the metal shield therein whereby the flange of the shield is flush with the mating face thereabout, and wherein each contact has an arched section projecting into the cavity whereby for an electrostatic charge positioned in a distance from the front opening of the cavity, the distance to the arched section is generally longer from the electrostatic charge than to the front edge of the flange.

2. The electrical connector as described in claim 1, wherein the passageways are in two, upper and lower, rows positioned on two opposite sides of the cavity and each communicating with the cavity through an opening, each passageway being closed in the front with a restraining block thereabout for engagement with an engagement section of the contact for preloading effect.

3. The electrical connector as described in claim 2, wherein each contact has a flat body anchored within the corresponding passageway in an interference fit, the contact in the upper row has a biased tail with regard to a tail of the contact in the corresponding lower passageway so that the tails of the contacts in the upper and the lower rows can be alternatively aligned in the rear for corresponding to a series of juxtaposed traces positioned on a board on which the connector is mounted.

4. The electrical connector as described in claim 1, wherein said electrical connector further comprises a pair of rivets extending through two pairs of holes respectively positioned on two opposite sides of the housing and the shield for securement, and a pair of bails respectively attached thereto.

5. An electrical female connector having improved ESD protection means comprising:

an elongated insulative housing including a flange section having a front face thereon;

a pair of mounting sections positioned on two opposite sides of the housing for securement with a board on which the housing is mounted;

a plurality of contacts positioned within a corresponding number of passageways of the housing, respectively in a front-to-back direction, a bowed portion of each contact projecting out of the corresponding passageway and entering a central cavity of the housing; and a conductive shield comprising a front surface corresponding to the front face of the flange section of the housing, a shielding portion projecting forwardly from said front surface, wherein a portion of a front end of said shield portion has a wave section to form some projecting points thereof under a condition that said projecting points are disposed vertically spaced from a front opening of said central cavity of the housing in which a complementary plug connector is received, and wherein to a spaced external charge source, the wave section of the shield is generally closer from the charge source than the bowed portions of the contacts.

6. The electrical female connector as described in claim 5, wherein said housing further comprises a mating portion projecting from said flange section and terminated at a mating face, and said shield portion of the shield surrounding said mating portion of the housing, whereby a flange vertically extends from a circumferential edge of said shield portion of the shield and the wave section is positioned at a front edge of said flange of the shield.

7. The electrical female connector as described in claim 6, wherein the wave section of the flange is of a type having a series of notches at the front edge of the flange in a vertical direction.

8. The electrical female connector as described in claim 6, wherein a bracket incorporating a rivet is positioned on each mounting section to fasten the shield and a bail with a strip thereto.

9. The electrical female connector as described in claim 6, wherein tail portions of the contacts are aligned.

10. A metal shield for providing a female connector housing with ESD protection, comprising:

a front surface for covering a front face of the connector housing and being fastened thereto;

a shielding portion projecting from the front surface for encircling a mating portion of the connector housing in which female contacts are embedded; and a flange extending vertically from a circumferential edge of the shielding portion, at least an opening formed therein, the flange having a wave section around said opening, wherein said wave section of the flange is of a type having a series of notches thereof in a vertical direction under a condition that said notches define a larger vertical dimension than corresponding portions of a complementary plug connector which is inserted into said opening of the flange, such that said notches are not mechanically engaged in the vertical direction with said portions of said complementary plug connector.

* * * * *